US005470153A

United States Patent [19]

De Naeghel

[11] Patent Number: 5,470,153

[45] Date of Patent: Nov. 28, 1995

[54] MIXING DEVICE FOR AERATING AND MIXING PUMPABLE SEMI-LIQUID PRODUCTS

[75] Inventor: Emiel De Naeghel, Schoten, Belgium

[73] Assignee: Machines Collette, Wommelgem, Belgium

[21] Appl. No.: 195,022

[22] Filed: Feb. 14, 1994

[30] Foreign Application Priority Data

Feb. 12, 1993 [BE] Belgium ..... 09300135

[51] Int. Cl.[6] ..... B01F 7/16

[52] U.S. Cl. ..... 366/303; 366/307

[58] Field of Search ..... 366/303, 304, 366/307, 306, 305, 309

[56] References Cited

U.S. PATENT DOCUMENTS

| | | | |
|---|---|---|---|
| 2,115,123 | 4/1938 | Russell | 366/303 |
| 2,125,455 | 8/1938 | McLean | 366/303 |
| 2,626,786 | 1/1953 | McGlothlin | 366/303 |
| 4,878,426 | 11/1989 | Tadema | 366/303 |
| 4,976,547 | 1/1990 | Hisanaga | 366/303 |
| 5,121,992 | 6/1992 | List | 366/303 |

*Primary Examiner*—Robert W. Jenkins

[57] ABSTRACT

A mixing device which has a pressurizable chamber for aerating and mixing pumpable products is characterized in that the chamber has its mixing rotor shaft oriented vertically during operation of the mixing device in order to improve efficiency of mixing, reduce vibrations, and to reduce maintenance costs associated with prior art mixing apparatus.

6 Claims, 1 Drawing Sheet

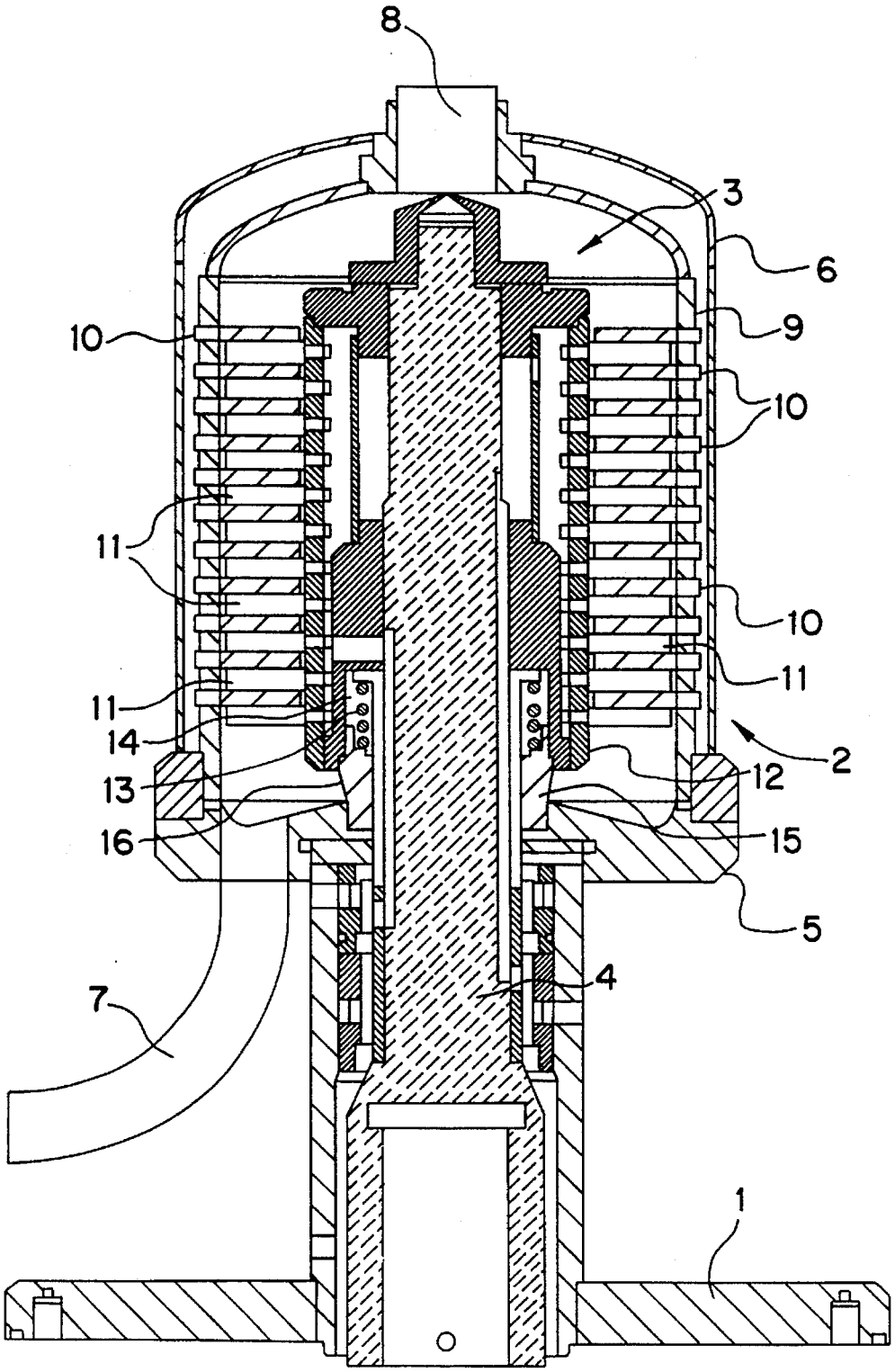
8
3
6
9
10
10
11
10
11
11
14
2
13
12
16
15
5
4
7
1

MIXING DEVICE FOR AERATING AND MIXING PUMPABLE SEMI-LIQUID PRODUCTS

This invention relates to a mixing device for aerating and mixing pumpable semi-liquid products as produced in the food industry, the pharmaceutical and/or cosmetic industry, comprising, in addition to a frame for receiving i.a. pumps, motors, and the like, which are required for circulating both the products to be processed and cooling-water, a mixing chamber acting as stator, the inner wall of which is provided with radial pins, and a rotor axially arranged therein and also provided with radial pins, these latter pins rotating between the pins belonging to the stator.

Mixing devices of the intended type are known and have always been designed up to now in such a manner that the rotor has its rotor shaft disposed horizontally.

The term "horizontal" has to be understood here very clearly within the scope of the application, i.e. in the description and in the claims, as being the arrangement of this shaft together with rotor and mixing chamber in the operative position of the mixing device. Related hereto is that the terms "at the top" and "at the bottom" have to be understood in the same spirit.

The horizontal arrangement of the rotor shaft of mixing devices of the intended type involves a number of drawbacks, the most important of which are summarized hereinafter.

1. Due to clear reasons in connection with the maintenance of the interior of the mixing chamber and the rotor, the shaft of the rotor is cantilevered. This inevitably results in vibrations in this rotor shaft starting from a certain rotational speed. Due to these vibrations, the spacing between the pins belonging tot the inner wall of the cylindrical mixing chamber and those belonging to the rotor shaft cannot be taken as small as would be desirable. Since the wall of the mixing chamber is cooled down, different products circulating through the mixing chamber produce a film on said fixed and rotating pins which hampers the effect of the rotor and therefore of the mixing operation.
2. The horizontal arrangement of the mixing chamber of the conventional mixing device produces, due to the gravity force, an unbalanced situation of the product to be mixed within the mixing chamber.
3. In case of the horizontal arrangement of the mixing chamber, the provision of the bearing of the relatively long rotor shaft in the mixing chamber involves very serious problems as to cleaning and maintenance of the device.
4. In case of the up to now usual horizontal arrangement of the mixing chamber, there are inevitably always a number of ducts on the outer side of the cylindrical mixing chamber which complicate the maintenance of the exterior of this mixing chamber.
5. Finally, the cooling-water further does not circulate in the cooling jacket of the mixing chamber in the most advantageous way. This has to do with the formation of an air bubble which will be present in the upper part of the horizontal mixing cylinder.

An object of the present invention is to obviate these and a series of other known drawbacks.

In order to achieve this according to the invention, said mixing chamber together with the rotor and rotor shaft mounted axially therein extend vertically in the operative position of the mixing device.

The invention permits further to arrange the inlet for supplying the semi-liquid products to be mixed at the bottom in the vertically disposed mixing chamber and the outlet for the mixed and/or aerated products at the top in the vertical mixing chamber.

Other details and advantages of the invention will become apparent from the following description of a mixing device for aerating and mixing pumpable semi-liquid products according to the invention. This description is only given byway of example and does not limit the invention. The reference numerals relate to the sole drawing FIGURE.

BRIEF DESCRIPTION OF THE DRAWING

The drawing FIGURE is a longitudinal section through the vertically disposed mixing chamber together with the rotor and rotor shaft borne therein.

DETAILED DESCRIPTION

Of course, the mixing device shown in this single FIGURE has been reduced here to the essential components thereof, namely the mixing chamber 2 with rotor 3 and rotor shaft 4 disposed vertically onto the frame 1.

The mixing chamber 2 is cylindrically shaped and can be considered as the stator of the mixing device. The bottom of the mixing chamber 2 is indicated with reference numeral 5. The mixing chamber 2 has a cylindrical jacket 6 for the cooling-water.

The inlet 7 of the semi-liquid products crosses the bottom plate and debouches in the mixing chamber 2 completely at the bottom side of the mixing chamber 2.

The outlet 8 for the aerated and mixed products is situated centrally at the top of the mixing chamber 2. The mixing chamber is capable of being pressurized by the input inlet 7 so as to force the mixed products to exit the chamber 2 through outlet 8.

The vertical arrangement of the shaft 4 of the rotor 3 offers a series of advantages which considerably distinguish the mixing device according to the invention, characterised mainly by this vertical arrangement of the mixing chamber and rotor, from the hitherto known mixing devices wherein the rotor and rotor shaft are in a horizontal or a substantially horizontal position.

In a mixing device according to this invention, the inner wall 9 of the mixing chamber 2 is provided with a very large number of pins 10 which are rigidly connected to this inner wall 9.

The pins 11, which are fixed onto the rotor 3, rotate between the pins 10 belonging to the actual stator of the mixing device. In practice, these pins 11 are fixed onto a cylinder 12 which is clamped at the top and at the bottom with respect to the shaft 4 through the use of known technical means.

Due to the fact that the rotor shaft 4 is now arranged vertically in the mixing device according to the invention, this shaft may be made shorter and no vibrations are no longer observed, contrary to the situation up to now with mixing devices equipped with a horizontal rotor. As a very remarkable consequence of providing a vertical rotor the distance the pins 10 and the pins 11 may be very small (in the range of about 1.5 mm). Further, the ends of the pins 10 (stator) can be rotated very close to the cylinder 12. This is clearly also true for the opposite situation, i.e. the ends of the pins 11 (rotor) may extend very close to the inner wall of the mixing chamber.

In both cases, this distance can be reduced to 0.5 mm. The fact that these dimensions may be reduced to such an extent can be explained by the complete absence of vibrations as a direct consequence of the vertical arrangement of the rotor and rotor shaft.

In such an arrangement it will also be noticed that the outer wall of the cylindrical mixing chamber contains not a single in or outlet. The inlet 7 enters, as already mentioned hereinabove, the mixing chamber through the bottom plate S near the rotor shaft 4 while the outlet 8 is situated centrally in the top portion of the mixing chamber, This also results in a very homogeneous aeration and mixing of the processed materials which is not the case in mixing devices with a horizontal rotor since, as a result of gravity, certain heavier fractions tend to frequent the lowermost portion of the horizontally disposed mixing chamber.

Further, the cooling-water circulating in the jacket 6 no longer produce an air-bubble at the top of the horizontally disposed mixing chamber, which bubble will hardly move or will not move. In fact, in this invention such an air-bubble is not produced at all in the upper portion of the jacket 6.

When considering the mixing characteristics of the processed product, the advantages of the vertical arrangement of the rotor in the mixing chamber are immediately apparent.

Due to the fact that the shaft length from the rotor to the motor, which has not been shown in the Figure, can be reduced to a minimum, this shaft may be supported by the motor itself in another embodiment of the invention, not shown. This arrangement therefore does not require bearing housing for supporting this relatively large and heavy mass. Thanks to the vertical arrangement of the rotor, the bearing housing may be dropped so that in this way the shaft may have a very short length. This assures the already earlier discussed vibration free operation of the mixing device.

An important advantage of the mixing device according to the invention coupled to this vertical arrangement consists in the possibility to design the seal at the bottom of the mixing chamber 2 in such a way that the maintenance of the mixing chamber at the bottom at the seal does no longer poses any problem. The spring 13 is entirely enclosed in the space 14. The seal used here could be conceived due to the fact that the short rotor shaft, as a direct result of the vertical arrangement of the rotor, permits these seal structures. The space 14 wherein the spring 13 is located is closed off now completely through the mechanical seal consisting of a carbon/ceramic or pure ceramic ring 15 with a lip seal 16 fitted therearound.

Downstream from the outlet 8, a counter pressure control regulator, which is not shown in the drawing, is connected to the discharge duct for building up a counter pressure in this outlet duct.

This construction enables therefore to avoid contact of the spring 13, which always creates a dead angle in a horizontal arrangement of the rotor shaft, with the product to be processed. Cleaning of the mixing device is thus improved.

It will also be noticed that, due to the vertical arrangement of the rotor shaft not a single duct or apparatus ends on the exterior of the mixing chamber, except of course for the outlet duct. Due to the vertical arrangement of the rotor, it is therefore possible to dispose all connections of ducts on the inner side of the frame which has not been shown in the drawings. Therefore all ducts run on the bottom side of the device towards their destination. The cooling or heating medium, air tubings, the electricity cables and the supply for the pump no longer form obstacle on the outer side of the machine.

By separating the electrical components and by disposing the electrical box on a distance, possible vibration of the device have no influence onto these components.

The invention is not limited to the hereabove described embodiment and modifications could be applied thereto provided they fall within the scope of the annexed claims.

What is claimed is:

1. A mixing device which aerates and mixes pumpable semi-liquid products comprising:

a frame;

a cylindrically-shaped mixing chamber means, having a circumference wall surface with no inlets or outlets, a bottom surface having an inlet, and atop surface having an outlet, said chamber means capable of being pressurized above atmospheric pressure so that products which are input to said chamber means through said inlet at a pressure which exceeds atmospheric pressure exit said chamber means through said outlet, said chamber means supported by said frame so that the axis of the cylinder shape is positioned substantially vertically when said mixing device is in operation, said mixing chamber means having fixed pins attached to an inner surface of said circumference wall of said mixing chamber means so as to extend radially toward the center axis of said chamber means;

a rotor axially arranged in said mixing chamber means and provided with radial pins which move between said fixed pins when said rotor is rotated, thereby mixing said products introduced into the mixing chamber.

2. The mixing device of claim 1, further comprising: a water jacket which surrounds at least a portion of said mixing chamber

3. The mixing device of claim 2, wherein the distance between said radial fixed pins and said radial pins that move is about 1.5 mm.

4. The mixing device of claim 3, wherein the radial pins that move extend to within 0.5 mm of the inner wall of the mixing chamber.

5. The mixing device of claim 1, wherein the distance between said radial fixed pins and said radial pins that move is about 1.5 mm.

6. The mixing device of claim 1, wherein the radial pins that move extend to within 0.5 mm of the inner wall of the mixing chamber.

* * * * *